United States Patent [19]

Matsumoto

[11] 4,032,013

[45] June 28, 1977

[54] APPARATUS FOR ARRANGING AND STORING BOBBINS OF YARN OR THREAD

[76] Inventor: Kimiko Matsumoto, 324-1, Oaza-Shirakibaru, Onojo, Fukuoka, Japan

[22] Filed: Nov. 10, 1975

[21] Appl. No.: 630,338

Related U.S. Application Data

[63] Continuation of Ser. No. 476,416, June 4, 1974, abandoned.

[52] U.S. Cl. ..... 211/13; 242/130.3; 242/125.2

[51] Int. Cl.[2] ..... A47F 7/00; B65H 49/02

[58] Field of Search ..... 211/13, 59, 123, 124; 242/130.3, 130.2, 130.1, 130, 129.71, 125.2, 125.3

[56] References Cited

UNITED STATES PATENTS

| | | | |
|---|---|---|---|
| 808,114 | 12/1905 | Rowley et al. | 242/125.2 |
| 904,598 | 11/1908 | Besse | 242/130.3 |
| 1,336,554 | 4/1920 | Davis | 242/125.3 |
| 1,443,533 | 1/1923 | Hall et al. | 242/125.2 |
| 1,730,431 | 10/1929 | Keefer | 242/130 |
| 2,265,126 | 12/1941 | Bersche | 242/125.2 |
| 2,466,861 | 4/1949 | Peterson | 242/130.3 |
| 2,496,945 | 2/1950 | Johnson | 242/125.2 |
| 2,727,663 | 12/1955 | Gribben | 242/130 |
| 3,473,756 | 10/1969 | Jones | 242/137 |
| 3,568,950 | 3/1971 | Niwa | 211/13 |

*Primary Examiner*—Robert A. Hafer
*Attorney, Agent, or Firm*—Robert E. Burns; Emmanuel J. Lobato; Bruce L. Adams

[57] ABSTRACT

An apparatus for storing bobbins of yarn or thread in an arranged condition. A container comprising a frame is provided having crosspieces on which are mounted posts pivotally for pivoting from an upright position in a direction for receiving bobbins thereon. The post is inserted into the central bore of the bobbin while pivoted in a direction for receiving the bobbin and then is returned to an upright condition for storing the bobbin thereon. Another embodiment has bobbin-holders that are provided with an insert portion that is inserted into the bore of the bobbin and then the bobbin-holder with the bobbin suspended thereon is disposed depending from the crosspieces of the frame.

2 Claims, 6 Drawing Figures

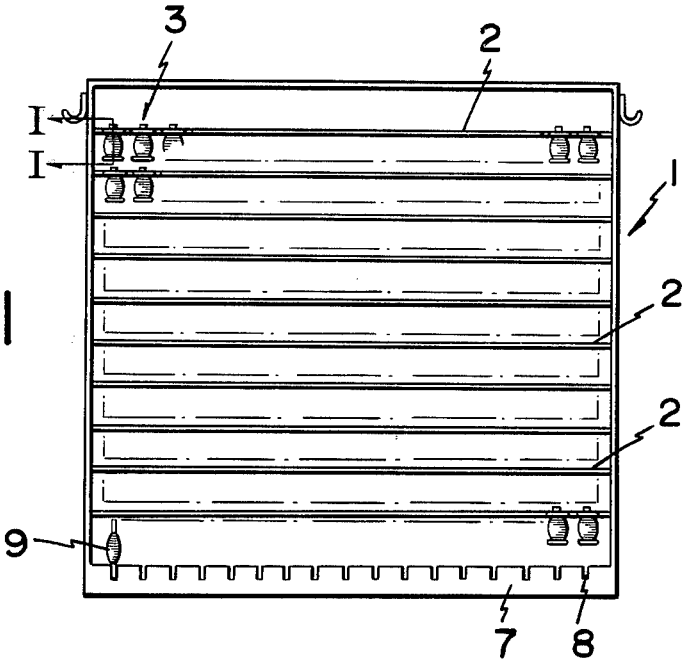
FIG. 1
FIG. 4
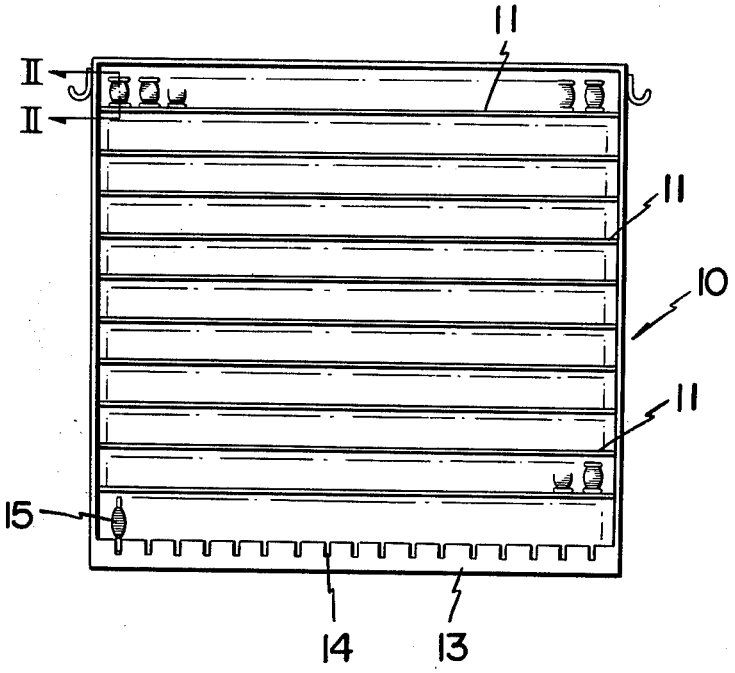

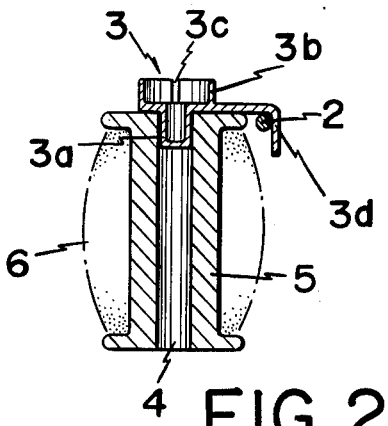
FIG. 2
FIG. 3
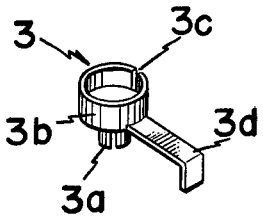
FIG. 5
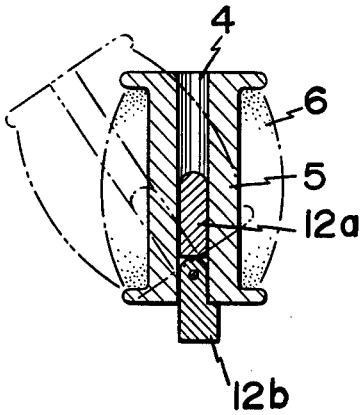
FIG. 6
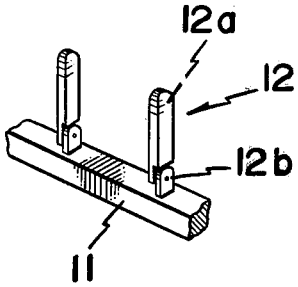

APPARATUS FOR ARRANGING AND STORING BOBBINS OF YARN OR THREAD

This is a continuation, of application Ser. No. 476,416, filed June 4, 1974.

BACKGROUND OF THE INVENTION

This invention relates generally to bobbins and more particularly to an apparatus for storing in an arranged condition bobbins which are filled or partially filled with yarn or thread and the like.

In making of clothing, for example dresses, many colors and types of threads or yarns are used. When the bobbins are supplied for making of clothing or the like they may be stored in a box and are not readily accessible during work. Furthermore, while some of them may be partially used then used again the bobbins may become scattered throughout the workroom and it is troublesome to find the desired bobbin. The partially filled bobbins may likewise be stored in containers which makes their accessibiliy reduced.

SUMMARY OF THE INVENTION

It is a principal object of the present invention to provide an apparatus wherein filled or partially filled bobbins may be stored in an arranged condition and readily accessible.

It is another object of the present invention to provide a new and improved bobbin-holder arrangement for arranging bobbins thereon.

The apparatus according to the invention has a frame and a plurality of crosspieces spaced from each other. A plurality of bobbin-holders for storing the bobbins individually thereon are provided. Each bobbin-holder has an insert portion thereon insertable into the bore of the bobbin removably for holding a bobbin thereon. The bobbin-holder is provided with means for attaching it individually on the crosspieces.

In one embodiment a hook is provided for suspending the bobbin-holder with a individual bobbin thereon. In a second embodiment a post is pivotally mounted on the crosspieces and these are pivotable in a forwardly direction from the upright position for receiving a bobbin by insertion of the post into the bore of the bobbin and then the post is returned to an upright position for temporarily holding the bobbin thereon.

BRIEF DESCRIPTION OF THE DRAWINGS

Other objects and advantages of the apparatus for storing bobbins in an arranged condition according to the invention will appear from the following description of an example of the invention, and the novel features will be particularly pointed out in the appended claims.

FIG. 1 is a front elevation view of an apparatus for storing bobbins in an arranged condition according to the invention;

FIG. 2 is a elevation section view of a bobbin and bobbin-holder taken along section line 1—1 of FIG. 1.

FIG. 3 is a perspective view of a bobbin-holder of the type shown in FIG. 2.

FIG. 4 is a front elevation view of a second embodiment of an apparatus for storing bobbins in an arranged condition according to the invention;

FIG. 5 is an elevation section view of another embodiment of a bobbin-holder and taken along section line 1—1 of FIG. 4.

FIG. 6 is a fragmentary perspective view of bobbin-holders of the type used in the embodiment of the apparatus illustrated in FIGS. 4 and 5.

DESCRIPTION OF THE PREFERRED EMBODIMENTS

According to the drawing a box 1 has a plurality of crosspieces 2 spaced from each other and extending transversely thereof. The box has sides forming a frame and is open on one side and is intended for storage of bobbins with yarn and thread thereon in the vicinity of a workers position, for example a sewing-table or a sewing machine where work is taking place in which the bobbins from the storage box will be required.

The bobbins in the embodiment of the invention illustrated in FIG. 1 are held in suspended condition in a bobbin-holder 3. The bobbin-holder 3 has an insert portion 3*a* which is tubular and cylindrical in configuration and split longitudinally for ease of insertion into a bore 4 of a bobbin 5 having a thread or yarn 6 thereon either as a completely filled package or partially filled package. The term bobbin as used herein will refer to the bobbin itself with yarn or thread either in a complete package or partial package that is intended to be stored in the apparatus according to the invention.

The bobbin-holder 3 is provided with another tubular portion 3*b* of greater diameter than the insert cylindrical portion 3*a*. This larger cylindrical portion forms a shoulder against which the bobbin 5 seats and is provided with a slit or split 3*c* for receiving a yarn or thread therein when a bobbin or package is disposed on the bobbin-holder. The bobbin-holder has a hook 3d extending from the bobbin-holder for suspending it with the bobbin thereof from a crosspiece 2 as illustrated in FIGS. 1 and 2.

A bottom member 7 of the box or frame 1 has recesses or notches 8 in which bobbins 9 of another type may be stored. In this case the bobbins are of smaller cross section than those heretofore described and made from cardboard and the like.

In a second embodiment of an apparatus according to the invention comprises a box 10 having spaced crosspieces 11 thereon in the manner of the box or frame 1 described heretofore. In this embodiment the bobbin-holders are constructed to hold the bobbins 5 upright on the crosspieces 11 as illustrated in FIG. 4. The bobbin-holders in this instance each comprise a post 12 having an insert portion 12*a* pivotally mounted on a support bar 12*b* which itself is secured to its crosspiece 11.

In order to insert a bobbin 5 onto the bobbin-holder the post 12 is pivoted from an upright position toward the open front of the box to a position displaced from the vertical and shown in broken lines in FIG. 5. A bobbin 5 is disposed on the bobbin-holder by insertion of the insert portion 12*b* of the post 12 of the bobbin-holder into the bore 4 of a bobbin. The bobbin is then pushed into the upright position so that the post 12 assumes the upright or vertical position and a bobbin is accordingly then in position for temporary storage until needed in the frame or box 10.

In this embodiment a lower member of the case or box 10 has a lower frame member 13 having recesses or notches 14 which are disposed bobbins or spools of thread or yarn 15 similarly to the first embodiment.

These latter spools or bobbins are likewise of smaller cross section as before described.

What I claim and desire to secure by letters patent:

1. Apparatus for storing bobbins of yarn or thread comprising, a frame having a plurality of horizontal, vertically spaced, rod-like crosspieces spaced vertically from each other a distance greater than the axial length of a bobbin and used in an upstanding position in use, a plurality of bobbin-holders for storing bobbins with yarn or thread individually depending therefrom on respective ones of said crosspieces, each bobbin-holder having an insert portion insertable axially into an axial bore of a bobbin for removably holding a bobbin depending on said bobbin-holder, hook means on each bobbin-holder for removably freely hanging the bobbin-holders individually on said crosspieces in a condition with a corresponding bobbin suspended on said insert portion, said insert portion comprising a split, hollow cylindrical portion of lesser axial length than a bobbin and insertable into the axial bore of a bobbin in an inwardly compressed state, said bobbin-holder having another hollow cylindrical portion of greater diameter as an upward extension on said insert portion defining therewith an annular shoulder limiting the axial extent of insertion of said insert portion into the corresponding bobbin, said hook means comprising a hook extending outwardly from said another hollow cylindrical portion for removably suspending said bobbin-holder on a crosspiece with a bobbin depending therefrom for removal of the individual bobbin-holder and the corresponding bobbin from the crosspiece jointly and for return to a hanging position jointly on a crosspiece, and said another cylindrical portion having an axial slit for receiving an end of yarn therein from the corresponding bobbin to avoid thereof from said bobbin.

2. Apparatus for storing bobbins of yarn or thread according to claim 1, in which said frame comprises a lower crosspiece having notches for seating bobbins in the individual notches, and the last-mentioned bobbins being different in at least axial configuration than the prior-mentioned bobbins.

* * * * *